US005283091A

United States Patent [19]

Darvell et al.

[11] Patent Number: 5,283,091

[45] Date of Patent: Feb. 1, 1994

[54] TAPE FLAG WITH TRANSPARENT BOUNDARY INDICATING COATING

[75] Inventors: Wayne K. Darvell, North St. Paul; Thomas J. Barnidge, Burnsville; Karyn A. Roszak, Eagan, all of

[73] Assignee: Minnesota Mining and Manufacturing Company, St. Paul, Minn.

[21] Appl. No.: 772,078

[22] Filed: Oct. 7, 1991

[51] Int. Cl.[5] ..... B42D 9/00

[52] U.S. Cl. ..... 428/40; 40/359; 40/360; 283/37; 283/38; 283/39; 283/81; 428/42; 428/195; 428/343; 428/354; 428/914

[58] Field of Search ..... 428/40, 42, 343, 914, 428/354, 195; 283/81, 37, 38, 39; 281/42, 51, 2, 5; 462/901; 40/359, 360

[56] References Cited

U.S. PATENT DOCUMENTS

| | | | |
|---|---|---|---|
| 2,016,312 | 10/1935 | Bodle | 156/235 |
| 3,463,515 | 8/1969 | Thompson | 283/37 |
| 3,583,358 | 6/1971 | Hanson | 428/194 |
| 3,937,493 | 2/1976 | Fasbender | 283/41 |
| 3,958,816 | 5/1976 | Remmey | 428/194 |
| 4,260,656 | 4/1981 | Mullen | 283/81 |
| 4,680,210 | 7/1987 | Corcoran | 283/37 |
| 4,696,706 | 9/1987 | Griffin et al. | 156/62 |
| 4,770,320 | 9/1988 | Miles | 206/39.3 |
| 4,907,825 | 3/1990 | Miles et al. | 281/51 |
| 5,011,186 | 4/1991 | Bodziak | 283/81 |

FOREIGN PATENT DOCUMENTS

| | | | |
|---|---|---|---|
| 3033273A1 | 4/1982 | Fed. Rep. of Germany . | |
| 3537433A1 | 10/1986 | Fed. Rep. of Germany . | |
| 1260215 | 3/1961 | France . | |
| 150966 | 9/1983 | Japan | 428/194 |
| 174274 | 6/1935 | Switzerland . | |
| WO85/00781 | 2/1985 | World Int. Prop. O. . | |

OTHER PUBLICATIONS

International Search Report for PCT/US92/07091.

2 pages "Multi-tabs", brochure.

Medi-Tag-Redi-Tag brochure published by Medi-'-Tag-Redi-Tab P.O. Box 3130, Long Beach, CA 90803.

Redi-Tag brochure w/samples attached, published by Barbara Thomas Ent, Inc., Cypress, CA.

Ames EasiFlags brochure w/sample attached, published by Ames Color-File, Division of Ames Safety Envelope Company, 12 Part St. P.O. Box 120, Somerville, MA 02143-0120.

*Primary Examiner*—Ellis P. Robinson

*Assistant Examiner*—Nasser Ahmad

*Attorney, Agent, or Firm*—Gary L. Griswold; Walter N. Kirn; William L. Huebsch

[57] ABSTRACT

A sheet for temporarily marking a portion of a document. The sheet comprising an elongate layer of flexible polymeric material having a coating of repositionable pressure sensitive adhesive on a second end portion while being free of adhesive on both of the side surfaces along a first end portion thereof. The first end portion is visually distinctive, and the adhesive coated second end portion is generally transparent when adhered to a substrate. The second end portion has a coating along one of its side surfaces that visually distinguishes the second end portion from a substrate when the second end portion is adhered to a substrate while being sufficiently transparent to afford reading indicia on the substrate through the second end portion.

10 Claims, 1 Drawing Sheet

TAPE FLAG WITH TRANSPARENT BOUNDARY INDICATING COATING

TECHNICAL FIELD

The present invention relates to sheets used for temporarily marking portions of documents of the type comprising an elongate layer of flexible polymeric material having a coating of repositionable pressure sensitive adhesive on a second end portion of one of its side surfaces while being free of adhesive on both of its side surfaces along a first end portion thereof, its first end portion being visually distinctive, and its adhesive coated second end portion being generally transparent when adhered to a substrate.

BACKGROUND ART

U.S. Pat. No. 4,770,320 describes a product sold by Minnesota Mining and Manufacturing Company under the commercial designation "Post-it" brand tape flags. The tape flags are sheets for temporarily marking portions of documents, each of which sheets comprises an elongate layer of flexible polymeric material having a coating of repositionable pressure sensitive adhesive on one of its side surfaces along a second end portion, while being free of adhesive on both of its side surfaces along a first end portion thereof. Both of its end portions are adapted to be written on. Its first end portion is visually distinctive, and its adhesive coated second end portion is generally transparent when adhered to a substrate. Such a tape flag or sheet is useful for marking a portion of a document by having its second end portion adhered thereto while its first end portion projects beyond an edge of the document so that the marked portion of the document can be readily identified. In many cases, the portion of the document adjacent which the tape flag is adhered is that portion on which a person is to write information or sign the document. The portion of the tape flag adhered to the document is transparent, which is an advantage in that the person can then read information on the document adjacent the portion of the document on which the person is to add information or sign. It has been found, however, that persons often write information or sign at least partially over the transparent second end portion of the tape flag, thereby causing at least a portion of the information or of the signature to be lost when the tape flag is subsequently removed.

DISCLOSURE OF INVENTION

The present invention provides a tape flag or sheet of the type indicated above which restricts the problem noted above of having persons write information or sign at least partially over the transparent second end portion of the sheet when it is used to mark a portion of a document.

According to the present invention there is provided a tape flag or sheet for temporarily marking a portion of a document which sheet is generally of the type disclosed in U.S. Pat. No. 4,907,825 in that it comprises an elongate layer of flexible polymeric material having a coating of repositionable pressure sensitive adhesive on a second end portion of one of its side surfaces while being free of adhesive on both of its side surfaces along an opposite first end portion thereof, with the first end portion being visually distinctive, and the adhesive coated second end portion being generally transparent when adhered to a substrate. The sheet according to the present invention is modified from the sheet disclosed in U.S. Pat. No. 4,907,825 in that its second end portion has a coating along one of its side surfaces which allows the user to visually distinguish its second end portion from a substrate when its second end portion is adhered to that substrate while being sufficiently transparent to afford reading indicia on the substrate through its second end portion.

Such a coating which allows the user to visually distinguish its second end portion from a substrate can, for example, form a multiplicity of generally uniformly spaced repetitive indicia (e.g., dots, slashes, or words) edge to edge on the second portion of the sheet and can additionally form an arrow pointed toward the second end of the sheet. The sheet can additionally have indicia (e.g., sign here, note, fill in, etc.) on its visually distinctive first end portion that provide an indication of action to be taken by a user on portions of a substrate to which the second end portion of the sheet is releasably adhered. As an alternative to uniformly spaced repetitive indicia, the coating can form indicia (e.g., dots) that are randomly spaced along its second portion, or can be of a light distinctive color (e.g., light pink) and can be generally uniformly distributed along the second portion of the sheet.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
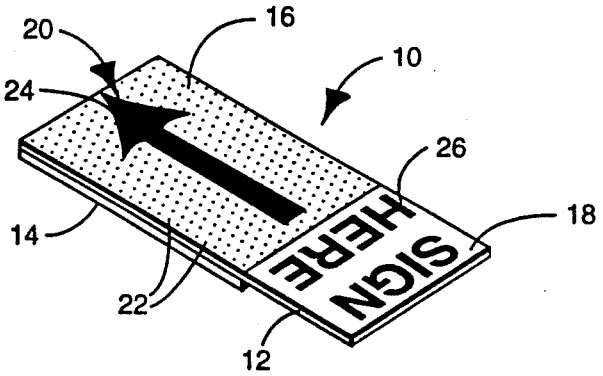
FIG. 1 is a perspective view of a sheet according to the present invention.

Referring now to FIG. 1 of the drawing, there is shown a tape flag or sheet according to the present invention for temporarily marking a portion of a document, which sheet is generally designated by the reference numeral 10.

The sheet 10 is made in accordance with the teachings in U.S. Pat. No. 4,907,825 which issued on Mar. 13, 1990, the content of which is hereby incorporated herein by reference. Generally the sheet comprises an elongate layer 12 of flexible polymeric material having a coating 14 of repositionable pressure sensitive adhesive on a second end portion 16 of one of its side surfaces while being free of adhesive on both of its side surfaces along an opposite first end portion thereof 18, with the first end portion 18 being visually distinctive (e.g., by being printed with a dark coating of brightly colored ink), and the adhesive coated second end portion 16 being generally transparent when adhered to a substrate.

The sheet 10 according to the present invention is modified from the sheet 10 disclosed in U.S. Pat. No. 4,907,825 in that its second end portion 16 has a coating 20 (e.g., of red ink) along one of its side surfaces which allows the user to visually distinguish its second end portion 16 from a substrate when its second end portion 16 is adhered to that substrate, while the coating 20 is sufficiently transparent to afford reading indicia on the substrate through the second end portion 16 of the sheet 10. As illustrated, the coating 20 that visually distinguishes the second end portion 16 from a substrate when the second end portion 16 is adhered to the substrate includes a portion forming a multiplicity of generally uniformly spaced repetitive indicia in the form of dots 22 each about 0.0215 inch in diameter evenly spaced about 0.060 inch apart in a square array with rows of the dots 22 in the array disposed at about a 45 degree angle with respect to the edges of the second end portion 16; and a portion 24 in the shape of an arrow 24 pointed toward the end of the sheet 10 opposite its first end portion 18. Also, the sheet 10 has indicia 26 printed along its first end portion 18 in the form of the words "SIGN HERE" providing an indication of action to be taken by a user on portions of a substrate to which the second end portion 16 of the sheet 10 is releasably adhered. Thus, when the second end portion 16 of the sheet 10 is adhered to a substrate by the coating 14 of repositionable pressure sensitive adhesive, an appropriate person seeing the substrate with the sheet 10 attached thereto will be guided by the sheet 10 as to the portion he is to sign and will be able to read any information on the substrate through the second end portion 16 of the sheet 10, while the coating 20 on the second end portion 16 of the sheet 10 will give that person a visual indication of the boundaries of the second end portion 16 of the sheet so that he will not have a tendency to sign over the second end portion. Thus the sheet 10 can subsequently be removed from the substrate without removing a portion of that persons signature.

Figure 2:
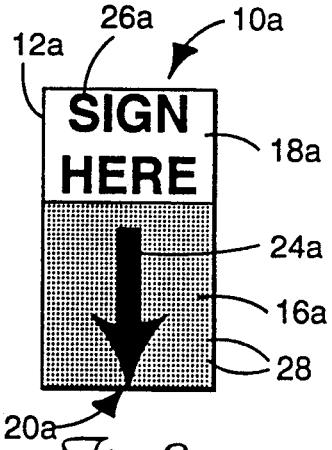
FIGS. 2 through 7 are plan views of six different alternative embodiments of the sheet according to the present invention.
Figure 3:
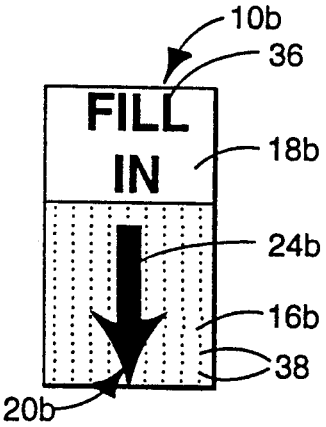

FIGS. 2 through 7 illustrate alternate embodiments of the sheet according to the present invention which have the same structure as the sheet 10 described above, with similar portions of the sheet being identified with similar reference numerals except for the addition of the suffix "a" for the embodiment in FIG. 2, "b" for the embodiment in FIG. 3, "c" for the embodiment in FIG. 3, etc.

In the sheet 10*a* illustrated in FIG. 2, the coating 20*a* that visually distinguishes the second end portion 16*a* from a substrate when the second end portion 16*a* is adhered to a substrate includes a portion forming a multiplicity of generally uniformly spaced repetitive indicia in the form of dashes 28 similar in size and spacing to the dots 22 in FIG. 1 with the dashes 28 disposed in a square array with rows of the dashes 22 in the array disposed at about a 90 degree angle with respect to the edges of the second end portion 16*a;* and a portion 24*a* in the form of an arrow pointed toward the end of the sheet 10*a* opposite its first end portion 18*a*.

In the sheet 10*b* illustrated in FIG. 3, the coating 20*b* that visually distinguishes the second end portion 16*b* from a substrate when the second end portion 16*b* is adhered to a substrate includes a portion forming a multiplicity of generally uniformly spaced repetitive indicia in the form of dots 38 similar in size to the dots 22 in FIG. 1 with the dots 38 disposed in a rectangular array with dots 38 spaced more closely in one direction than in the other and with the rows of the dots 38 in the array disposed at about a 90 degree angle with respect to the edges of the second end portion 16*b;* and a portion 24*b* in the form of an arrow pointed toward the end of the sheet 10*b* opposite its first end portion 18*b*. Also, the sheet 10*b* has indicia 36 printed along its first end portion 18*b* in the form of the words "FILL IN" providing an indication of action to be taken by a user on portions of a substrate to which the second end portion 16*b* of the sheet 10*b* is releasably adhered.

Figure 4:
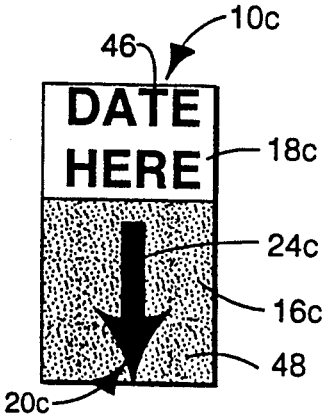

In the sheet 10*c* illustrated in FIG. 4, the coating 20*c* that visually distinguishes the second end portion 16*c* from a substrate when the second end portion 16*c* is adhered to a substrate includes a portion forming a multiplicity of randomly spaced repetitive indicia in the form of dots 48 similar in size to the dots 22 in FIG. 1; and a portion 24*c* in the shape of an arrow 24*c* pointed toward the end of the sheet 10*c* opposite its first end portion 18*c*. Also, the sheet 10*c* has indicia 46 printed along its first end portion 18*c* in the form of the words "DATE HERE" providing an indication of action to be taken by a user on portions of a substrate to which the second end portion 16*c* of the sheet 10*c* is releasably adhered.

Figure 5:
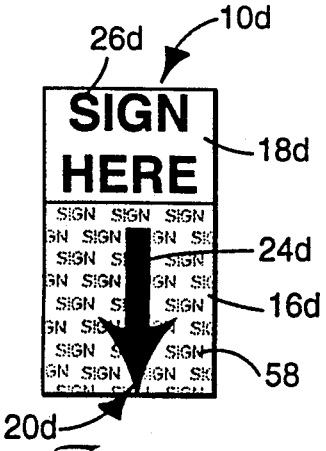

In the sheet 10*d* illustrated in FIG. 5, the coating 20*d* that visually distinguishes the second end portion 16*d* from a substrate when the second end portion 16*d* is adhered to a substrate includes a portion forming a multiplicity of generally uniformly spaced repetitive indicia in the form of dots 58 similar in size to the dots 22 in FIG. 1 with the dots 8 disposed in arrays each forming the word "SIGN" disposed at about 90 degree angles with respect to the edges of the second end portion 16*d;* and a portion 24*d* in the form of an arrow pointed toward the end of the sheet 10*d* opposite its first end portion 18*d*.

Figure 6:
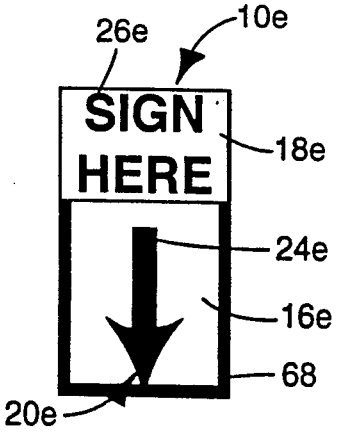

In the sheet 10*e* illustrated in FIG. 6, the coating 20*e* that visually distinguishes the second end portion 16*e* from a substrate when the second end portion 16*e* is adhered to a substrate includes a portion 68 forming a border at least partially around (i.e., around three sides of) the periphery of the second end portion 16*e* of the sheet 10*e;* and a portion 24*e* forming an arrow 24*e* pointed toward the end of the sheet 10*e* opposite its first end portion 18*e*.

Figure 7:
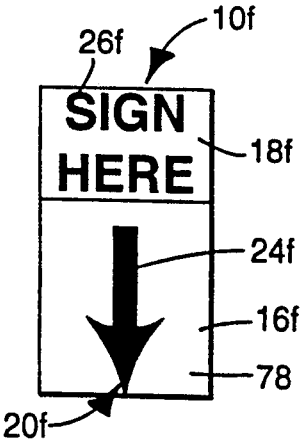

In the sheet 10*f* illustrated in FIG. 7, the coating 20*f* that visually distinguishes the second end portion 16*f* from a substrate when the second end portion 16*f* is adhered to a substrate includes a darker portion 24*f* that forms an arrow pointed toward the end of the sheet 10*f* opposite its first end portion 18*f*, and a portion 78 that is of a light distinctive color (e.g., pink) and is generally uniformly distributed along the second portion 16*f* around the portion 24*f*.

The present invention has now been described with reference to seven embodiments thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

We claim:

1. A sheet for temporarily marking a portion of a document, said sheet comprising an elongate layer of flexible polymeric material having opposite major side surfaces and first and second opposite ends, and having a coating of repositionable pressure sensitive adhesive on a second end portion of one of said side surfaces adjacent said second end while being free of adhesive on both of said side surfaces along a first nd portion thereof adjacent said first end, said first end portion being visually distinctive, and said adhesive coated second end portion being generally transparent when adhered to a substrate, wherein said second end portion has a light distinctive color or an indicia containing coating along one of said side surfaces that visually distinguishes the second end portion from a substrate when the second end portion is adhered to the substrate, said coating being sufficiently transparent to afford reading indicia on the substrate through the second end portion, wherein said light distinctive color coating or said indicia containing coating on said second end portion will reduce the placement of unwanted written information or signatures on said second end portion of said sheet.

2. A sheet according to claim 1 further including printed indicia on said first end portion providing an indication of action to be taken by a user on portions of a substrate to which the second end portion of the sheet is releasably adhered.

3. A sheet according to claim 1 wherein said coating that visually distinguishes said second end portion from a substrate when the second end portion is adhered to the substrate forms a multiplicity of repetitive indicia generally uniformly spaced along said second end portion.

4. A sheet according to claim 1 wherein said coating that visually distinguishes said second end portion from a substrate when the second end portion is adhered to the substrate forms both a multiplicity of generally uniformly spaced repetitive indicia and an arrow pointed toward the second end of the sheet.

5. A sheet according to claim 1 wherein said coating that visually distinguishes said second end portion from a substrate when the second end portion is adhered to the substrate forms both a multiplicity of generally uniformly spaced repetitive indicia and an arrow pointed toward the second end of the sheet, and said sheet has indicia along said first end portion providing an indication of action to be taken by a user on portions of a substrate to which the second end portion of the sheet is releasably adhered.

6. A sheet according to claim 1 wherein said coating that visually distinguishes said second end portion from a substrate when the second end portion is adhered to the substrate forms a border at least partially around the periphery of the second end portion of the sheet and an arrow pointed toward the second end portion of the sheet.

7. A sheet according to claim 1 wherein said coating that visually distinguishes the second end portion from a substrate when the second end portion is adhered to the substrate forms a multiplicity of spaced dots about 0.038 centimeter or 0.015 inch in diameter evenly spaced about 0.152 centimeter or 0.060 inch apart.

8. A sheet according to claim 1 wherein said coating that visually distinguishes said second end portion from a substrate when the second end portion is adhered to the substrate forms a multiplicity of randomly spaced dots.

9. A sheet according to claim 1 wherein said coating that visually distinguishes said second end portion from a substrate when the second end portion is adhered to the substrate forms a multiplicity of spaced words.

10. A sheet according to claim 1 wherein said coating that visually distinguishes said second end portion from a substrate when the second end portion is adhered to the substrate has a light distinctive color and is generally uniformly distributed along said second end portion.

* * * * *

UNITED STATES PATENT AND TRADEMARK OFFICE

CERTIFICATE OF CORRECTION

PATENT NO. : 5,283,091
DATED : February 1, 1994
INVENTOR(S) : Wayne K. Darvell et al.

It is certified that error appears in the above-identified patent and that said Letters Patent is hereby corrected as shown below:

Column 3,
Line 38, "In Fig. 3, etc." should read -- In Fig 4, etc. --.

Column 4,
Line 62, The word "nd" should read -- and --.

Signed and Sealed this

Twenty-fifth Day of June, 2002

*Attest:*

*Attesting Officer*

JAMES E. ROGAN
*Director of the United States Patent and Trademark Office*